US005114838A

United States Patent [19]

Yamada

[11] Patent Number: 5,114,838

[45] Date of Patent: May 19, 1992

[54] PROCESS FOR PREPARING SILVER HALIDE EMULSION AND SILVER HALIDE X-RAY PHOTOGRAPHIC MATERIAL CONTAINING SAID EMULSION

[75] Inventor: Sumito Yamada, Kanagawa, Japan

[73] Assignee: Fuji Photo Film Co., Ltd., Kanagawa, Japan

[21] Appl. No.: 540,734

[22] Filed: Jun. 20, 1990

[30] Foreign Application Priority Data

Jun. 21, 1989 [JP] Japan ..... 1-158925

[51] Int. Cl.[5] ..... G03C 1/015

[52] U.S. Cl. ..... 430/569

[58] Field of Search ..... 430/567, 569, 599, 603, 430/605

[56] References Cited

U.S. PATENT DOCUMENTS

| | | | |
|---|---|---|---|
| 4,401,754 | 8/1983 | Suzuki et al. | 430/599 |
| 4,835,095 | 5/1989 | Ohashi et al. | 430/567 |
| 4,888,273 | 12/1989 | Himmelwright et al. | 430/569 |
| 4,945,036 | 7/1990 | Arai et al. | 430/567 |

FOREIGN PATENT DOCUMENTS 348934 1/1990 European Pat. Off. .

OTHER PUBLICATIONS

Research Disclosure No. 225, Jan. 1983, pp. 20-58.

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A process for treating a tabular silver halide emulsion is disclosed comprising the steps of subjecting the tabular silver halide emulsion to reduction sensitization and to sulfur sensitization or selenium sensitization and/or gold sensitization in the presence of a nitrogen-containing heterocyclic compound which forms a complex with silver during the manufacture of the tabular silver halide emulsion, said tabular emulsion having a grain size distribution such that grains having an average aspect ratio of not lower than 3.0 constitute at least 50% of the total projected area of all of the silver halide grains. There is also disclosed a silver halide X-ray photographic material comprising a support having thereon at least one silver halide emulsion layer containing a tabular silver halide emulsion prepared in accordance with the above process.

13 Claims, No Drawings

PROCESS FOR PREPARING SILVER HALIDE EMULSION AND SILVER HALIDE X-RAY PHOTOGRAPHIC MATERIAL CONTAINING SAID EMULSION

FIELD OF THE INVENTION

The present invention relates to a process for preparing a silver halide emulsion having high sensitivity and which substantially does not cause fogging. The present invention also relates to a silver halide emulsion having high sensitivity and good graininess, and a silver halide photographic material containing said emulsion.

BACKGROUND OF THE INVENTION

Fundamental performance requirments for a photographic silver halide emulsion include high sensitivity, substantially no fogging and fine graininess.

In order to enhance the sensitivity of the emulsion, it is necessary to (1) increase the number of photons absorbed by each grain; (2) efficiently convert photoelectrons released by light absorption into a silver cluster (latent image); and (3) enhance development activity to effectively utilize latent image formation. The number of photons absorbed by a single grain can be increased by enlarging the grain size, but image quality is lowered. The enhancement of development activity is an effective means for enhancing sensitivity, but graininess is generally deteriorated when development is such a parallet type as color development. In order to enhance sensitivity without deleterious effect on graininess, it is most preferred to enhance the efficiency for converting photoelectrons into a latent image, namely, to increase the quantum sensitivity. It is necessary to remove inefficient steps such as recombination (recombination of an electron $e\ominus$ with a hole$\oplus$) and latent image dispersion as much as possible to increase the quantum sensitivity. It is known that a reduction sensitization method wherein fine silver nuclei having no development activity are formed in the interior of the silver halide grain or on the surface thereof, is effective in the prevention of recombination.

It is disclosed in Photogr. Sci. Eng., 19, 49 (1975) that when reduction sensitization is carried out such that the coated film of a gold and sulfur sensitized emulsion is degassed in vacuo and then heat-treated in a hydrogen gas atmosphere, sensitivity is increased to such an extent that the degree of fogging is low in comparison with a conventional reduction sensitization method. The sensitization method is well known as hydrogen sensitization and is effective as a sensitivity-increasing means on a laboratory scale. Furthermore, hydrogen sensitization is practically carried out in astronomical applications for the photographing of stars.

Reduction sensitization methods have long been proposed. For example, tin compounds have been disclosed as being useful reduction sensitizing agents in U.S. Pat. No. 2,487,850 to Carroll, polyamine compounds for this purpose are disclosed in U.S. Pat. No. 2,512,925 to Lowe et al., and thiourea dioxide compounds are disclosed in U.K. Patent 789,823 to Fallens. Comparisons of the properties of silver nuclei prepared by various reduction sensitization methods are disclosed in *Photographic science and Engineering*, Vol. 23, page 113 (1979), by Collier. Collier employed methods using dimethylamine borane, stannous chloride, hydrazines, ripening at a high pH and ripening at a low pAg. Furthermore, reduction sensitization methods are disclosed in U.S. Pat. Nos. 2,518,698, 3,201,254, 3,411,917, 3,779,777 and 3,930,867. Selection criteria for reduction sensitizing agents as well as methods for using the same are disclosed in JP-B-57-33572 (the term "JP-B" as used herein means an "examined Japanese patent publication"), JP-B-58-1410 and JP-A-57-179835 (the term "JP-A" as used herein means an "unexamined published Japanese patent application"). Methods for improving the preservability of reduction sensitized emulsions are described in JP-A-57-82831 and JP-A-60-178445. As described above, many proposals for reduction sensitization have been set forth. However, the increase in sensitivity using these reduction sensitization techniques is still inadequate in comparison with hydrogen sensitization wherein photographic materials are treated with hydrogen gas in vacuo, as reported by Moisar et al., *Journal of Imaging Science*, Vol. 29, page 233 (1985).

Conventional reduction sensitization methods are inadequate for state of the art photographic materials requiring high sensitivity and high image quality. Furthermore, hydrogen sensitization is disadvantageous in that the sensitization effect is lost when photographic materials thus prepared are exposed to air. Accordingly, the hydrogen sensitization method is unsuitable for many photographic applications.

SUMMARY OF THE INVENTION

An objective of the present invention is to provide a process for preparing a silver halide emulsion having high sensitivity and good graininess, and which substantially does not cause fogging of the emulsion.

A second objective of the present invention is to provide a photographic material having high sensitivity, good graininess, and substantially no fogging.

A further objective of the present invention is to provide an X-ray photographic material having high sensitivity, good graininess, and substantially no fogging.

The above-described objectives of the present invention have been achieved by providing:

(1) A process for treating a tabular silver halide emulsion comprising during the manufacture of the tabular silver halide emulsion the steps of (a) subjecting the tabular silver halide emulsion to reduction sensitization, and (b) subjecting the tabular emulsion to sulfur sensitization or selenium sensitization and/or gold sensitization in the presence of a nitrogen-containing heterocyclic compound which forms a complex with silver, said tabular emulsion having a grain size distribution such that grains having an average aspect ratio of not lower than 3.0 constitute at least 50% of the total projected area of all of the silver halide grains; and (2) a silver halide X-ray photographic material comprising a support having thereon at least one silver halide emulsion layer containing a tabular silver halide emulsion prepared in accordance with the process (1) above.

DETAILED DESCRIPTION OF THE INVENTION

The present invention is illustrated in detail below.

The manufacturing process of the silver halide emulsion of the present invention comprises the steps of grain formation, desalting, chemical sensitization, coating stages, etc. The grain formation comprises nucleation, ripening and growth. These stages are not necessarily carried out in sequence, but the order of the stages may be reversed, or these stages may be repeatedly carried out. The expression "reduction sensitization is carried out during the manufacture of the tabular silver halide emulsion" as used herein means that reduction sensitization may be carried out at any stage, of the manufacturing process as described above. For example, reduction sensitization may be carried out during nucleation at the early stage of grain formation, or during the course of physical ripening or growth. Alternatively, reduction sensitization may be carried out before or after chemical sensitization. When chemical sensitization is conducted together with gold sensitization, it is preferred that reduction sensitization is carried out before chemical sensitization to avoid fogging. Most preferably, reduction sensitization is carried out during the growth of the silver halide grains. The term "during growth" as used herein refers to a method wherein reduction sensitization is carried out while the silver halide grains are physically ripened or grown by the addition of a water-soluble silver salt and a water-soluble alkali halide, as well as a method wherein the growth of the grains is temporarily suspended, and the grains are subjected to reduction sensitization and then further grown.

The reduction sensitization of the present invention includes methods wherein conventional reducing agents are added to the silver halide emulsion; a method called silver ripening wherein the grains are grown or ripened in a low pAg environment of 1 to 7; and a method called high pH ripening wherein grains are grown or ripened in a high pH environment of 8 to 11. These methods may be used either alone or in combination of two or more thereof.

Methods wherein the reduction sensitizing agents are added to the emulsion are preferred, because the level of reduction sensitization can be finely controlled.

Conventional reduction sensitizing agents for use in the present invention include stannous salts, amines, polyamines, hydrazine derivatives, formamidinesulfinic acid, silane compounds, ascorbic acid compounds and boranes. These compounds can be used in the present invention and may be used either alone or in combination of two or more thereof. Preferred reduction sensitizing agents include ascorbic acid, thiourea dioxide and dimethylamine borane. The amount of the reduction sensitizing agent to be added varies depending on the manufacturing conditions for the preparation of the emulsion, but the addition amount is preferably $1\times10^{-8}$ to $1\times10^{-3}$ mol, and particularly preferably $1\times10^{-7}$ to $1\times10^{-5}$ mol per mol of silver halide.

In one embodiment of the invention the reduction sensitizing agent is dissolved in a solvent such as an alcohol, glycol, ketone, ester or amide, and is then added during the formation of the grains or before or after chemical sensitization. The reduction sensitizing agent may be added at any stage during the manufacture of the emulsion, but it is particularly preferred that the reduction sensitizing agent is added during the growth of the grains and/or after the formation of grains, and prior to chemical sensitization. When the reduction sensitizing agent is present during the growth of the grains, the reduction sensitizing agent may be added to the reaction vessel prior to reaction of the water-soluble silver salt and alkali halide solutions However, it is more preferred that the reduction sensitizing agent is added at an appropriate time after the formation of nuclei and before the completions of addition of silver nitrate. The reduction sensitizing agent may be added to an aqueous solution of a water-soluble silver salt or a water-soluble alkali halide prior to reaction, and grains may be formed in the aqueous solution. A solution of a reduction sensitizing agent may be added portion wise or continuously over a longer period of time while the grains are being formed.

It is preferred that the thiosulfonic acid compounds described in Japanese Patent Application Nos. 63-159888 and 63-258787 are used together with the reduction sensitizing agent of the present invention.

Hydroxyazaindene compounds are conventionally employed as stabilizers for photographic emulsions, because these compounds inhibit the chemical ripening that occurs with sulfur-containing compounds. The compounds are added for the purpose of terminating the sulfur sensitization reaction and/or preventing fogging from occuring during the manufacturing process, storage or development processing of the photographic material. However, it is also known that the subject compounds increase photographic sensitivity. For example, U.K. patent 1,315,755 discloses that when azaindene is added to a silver halide emulsion prior to sulfur sensitization, in addition to a monovalent gold complex salt compound containing sulfur added simultaneously with the above addition of azaindene or after said addition, and ripening is conducted using a combined sulfur and gold sensitization method, then the intrinsic sensitivity of silver halides is increased in comparison with conventional sensitization methods. Furthermore, German Patent Application (OLS) 2,419,798 discloses that sensitivity is increased when a cubic monodisperse silver halide grain emulsion having a silver bromide content of not less than 80 mol% is sulfur sensitized, and hydroxytetrazaindene compounds are subsequently incorporated therein. Additionally, OLS 2,419,798 discloses that when crystal forms such as octahedral grains having a grain structure substantially surrounded by (111) planes and tabular grains other than those of cubic form are used, sensitivity is either reduced, or the degree of increase in sensitivity is slight. JP-A-51-77223 discloses that when certain kinds of hydroxytetrazaindene compounds are incorporated into a sulfur-sensitized silver halide photographic material, sensitivity is increased unless the average grain size of the silver halide grains exceeds 0.5 μm. However, the hydroxytetrazaindene compounds have been commonly added as stabilizers after chemical ripening in the photographic art, irrespective of whether the compounds have a sensitizing effect or whether the effect thereof is recognized. Hence, the methods described in the afore-mentioned JP-A-50-63914 and JP-A-51-77223 can not be considered to be novel sensitizing methods.

On the other hand, JP-A-58-126526 discloses a method wherein emulsions having high sensitivity and substantially no fogging are prepared by having azaindene compounds present during chemical sensitization of octahedral or tetradecahedral crystal grains.

JP-A-2-68539 discloses a method wherein emulsions having good pressure resistance and high sensitivity and substantially no fogging are prepared by allowing sensitizing dyes and azaindene compounds to be present during the chemical sensitization of tabular silver halide grains having an aspect ratio of not less than 3. It is known that tabular grains are superior for use X-ray photographic materials, because of the superiority thereof to spherical grains in covering power (blackening density per unit amount of silver), and color sensitization.

The present inventors have found that when tabular grains are subjected to reduction sensitization, and then the tabular grains are further subjected to sulfur sensitization or selenium sensitization and/or gold sensitization in the presence of a nitrogen-containing heterocyclic compound which forms a complex with silver, a silver halide emulsion having remarkably high sensitivity and substantially no fogging is obtained in comparison with the case wherein reduction sensitization is carried out in combination with gold and sulfur sensitization, or the case wherein gold and sulfur sensitization is carried out in the presence of a nitrogen-containing heterocyclic compound.

Examples of the heterocyclic ring of the nitrogen-containing heterocyclic compound for use in the present invention include a pyrazole ring, pyrimidine ring, 1,2,4-triazole ring, 1,2,3-triazole ring, 1,3,4-thiadiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, 1,2,4-triazine ring, 1,3,5-triazine ring, and rings comprising a combination of two or three of these rings such as a triazolotriazole ring, diazaindene ring, triazaindene ring, tetrazaindene ring and pentazaindene ring. Heterocyclic rings formed by condensing a monocyclic heterocyclic ring with an aromatic ring such as phthalazine ring, benzimidazole ring, indazole ring and benzthiazole ring can also be used.

Among these rings, azaindene rings are preferred. Azaindene compounds having a hydroxyl group as a substituent group such as hydroxytriazaindene, tetrahydroxyazaindene and hydroxypentazaindene compounds are more preferred.

The heterocyclic rings may have one or more substituent groups other than a hydroxyl group. Examples of such substituent groups include an alkyl group, a substituted alkyl group, an alkylthio group, an amino group, a hydroxyamino group, an alkylamino group, a dialkylamino group, an arylamino group, carboxy group, an alkoxycarbonyl group, a halogen atom and cyano group.

Examples of the nitrogen-containing heterocyclic compound comprising an azaindene ring for use in the present invention include, but are not limited to, the following compounds.

(1) 2,4-Dihydroxy-6-methyl-1,3a,7-triazaindene
(2) 2,5-Dimethyl-7-hydroxy-1,4,7a-triazaindene
(3) 5-Amino-7-hydroxy-2-methyl-1,4,7a-triazaindene
(4) 4-Hydroxy-6-methyl-1,3,3a,7-tetrazaindene
(5) 4-Hydroxy-1,3,3a,7-tetrazaindene
(6) 4-Hydroxy-6-phenyl-1,3,3a,7-tetrazaindene
(7) 4-Methyl-6-hydroxy-1,3,3a,7-tetrazaindene
(8) 2,6-Dimethyl-4-hydroxy-1,3,3a,7-tetrazaindene
(9) 4-Hydroxy-5-ethyl-6-methyl-1,3,3a,7-tetrazaindene
(10) 2,6-Dimethyl-4-hydroxy-5-ethyl-1,3,3a,7-tetrazaindene
(11) 4-Hydroxy-5,6-dimethyl-1,3,3a,7-tetrazaindene
(11) 4-Hydroxy-5,6-dimethyl-1,3,3a, 7-tetrazaindene
(12) 2,5,6-Trimethyl-4-hydroxy-1,3,3a,7-tetrazaindene
(13) 2-Methyl-4-hydroxy-6-phenyl-1,3,3a,7-tetrazaindene
(14) 4-Hydroxy-6-methyl-1,2,3a,7-tetrazaindene
(15) 4-Hydroxy-6-ethyl-1,2,3a,7-tetrazaindene
(16) 4-Hydroxy-6-phenyl-1,2,3a,7-tetrazaindene
(17) 4-Hydroxy-1,2,3a,7-tetrazaindene
(18) 4-Methyl-6-hydroxy-1,2,3a,7-tetrazaindene
(19) 7-Hydroxy-5-methyl-1,2,3,4,6-pentazaindene
(20) 5-Hydroxy-7-methyl-1,2,3,4,6-pentazaindene
(21) 5,7-Dihydroxy-1,2,3,4,6-pentazaindene
(22) 7-Hydroxy-5-methyl-2-phenykl-1,2,3,4,6-pentazaindene
(23) 5-Dimethylamino-7-hydroxy-2-phenyl-1,2,3,4,6-pentazaindene The addition amount of the nitrogen-containing heterocyclic compound depends on the grain size and composition of emulsion, and the ripening conditions, however, the addition amount is preferably, from $1\times10^{-4}$ to $1\times10^{-2}$ mol per mol of silver. The addition amount of the nirogen-containing heterocyclic compound is adjusted by controlling adsorption equilibrium conditions including pH and/or temperature during ripening. Two or more compounds in the combined amount within the desired range may be added to the emulsion.

The nitrogen-containing heterocyclic compound can be added to the emulsion by dissolving the compound in an appropriate solvent (e.g., water or an aqueous alkaline solution) having no adverse effect on the photographic properties of the emulsion, and then adding the resulting solution to the emulsion. Preferably, the addition is made simultaneously with or before the addition of the sulfur sensitizing agent or selenium sensitizing agent for chemical sensitization. The gold sensitizing agent is added during or after ripening for sulfur or selenium sensitization.

Conventional sulfur sensitizing agents can be used in the present invention. Examples of such sulfur sensitizing agents include thiosulfates, allylthiocarbamidourea, allyl isothiocyanate, cystine, p-toluenethiosulfonates and rhodanine. Furthermore, the sulfur sensitizing agents described in U.S. Pat. Nos. 1,574,944, 2,410,689, 2,278,947, 2,728,668, 3,501,313 and 3,656,955, German patent 1,422,869, JP-B-56-24937 and JP-A-55-45016 can be used. The sulfur sensitizing agents are used in an amount sufficient to effectively increase the sensitivity of the emulsion. The amount of the sulfur sensitizing agent to be added depends on the addition amount of the hydroxyazaindene compound and other reaction conditions such as pH, temperature, the size of silver halide grains, etc., but is generally in the range of from about $1\times10^{-5}$ to $1\times10^{-1}$ mol per mol of silver halide.

In the present invention, a selenium sensitizing agent can be used in place of the sulfur sensitizing agent. Examples of useful selenium sensitizing agents include aliphatic isoselenocyanates such as allyl isoselenocyanate, selenoureas, selenoketones, selenoamides, selenocarboxylic acids and esters thereof, selenophosphates and selenides such as diethyl selenide and diethyl diselenide. Specific examples thereof are described in U.S. Pat. Nos. 1,574,944, 1,602,592 and 1,623,499.

The addition amount of the selenium sensitizing agent depends on the various factors as described for the sulfur sensitizing agent, but is generally in the range of about $1\times10^{-9}$ to $1\times10^{-6}$ mol per mol of silver halide.

In the present invention, the oxidation number of the gold in the gold sensitizing agent may be positive monovalent or positive trivalent. Typical examples of useful gold sensitizing agents include chloroauric acid, chloroaurates such as potassium chloroaurate, auric trichloride, potassium auric thiocyanate, potassium rhodoaurate, tetracyanoauric acid, ammonium aurothiocyanate and pyridyl trichlolo-gold.

When sulfur sensitization or selenium sensitization is carried out in combination with gold sensitization, image specks by gold sensitization and image specks by sulfur and gold sensitization or image specks by selenium and gold sensitization are formed, and the relative number thereof and the composition of these image specks in particular greatly influence the electron trapping property and developability of the thus sensitized silver halide grains. Accordingly, the sensitization effect is greatly affected by the ratio of the gold sensitizing agent to the sulfur sensitizing agent or the selenium sensitizing agent. The relative amounts of the sensitizing agents are selected to effectively increase sensitivity in accordance with the ripening conditions.

The ratio of the addition amount of the gold sensitizing agent to the addition amount of the sulfur sensitizing agent or the selenium sensitizing agent is such that the ratio of the number of gold atoms to the number of sulfur atoms forming silver sulfide from the sulfur sensitizing agent or to the number of selenium atoms forming silver selenide from the selenium sensitizing agent is preferably from ½ to 1/200.

The gold sensitizing agent may be added simultaneously with the addition of the sulfur sensitizing agent or the selenium sensitizing agent, or during or after the sulfur or selenium sensitization stage.

Preferred effects are obtained in the present invention when the above-described nitrogen-containing heterocyclic compound is used together with a spectral sensitizing dye in the chemical sensitization.

Examples of useful spectral sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

Spectral sensitizing dyes for use in the present invention are described, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, JP-A-48-76525 and Belgian Patent 691,807. The addition amount of the spectral sensitizing dye is at least 300 mg, but less than 1500 mg, and preferably at least 400 mg, but less than 700 mg per mol of silver halide.

Nonlimiting examples of the spectral sensitizing dye effectively used in the present invention include the following compounds.

(1)

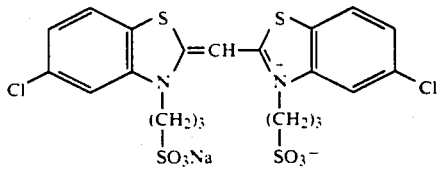

(2)

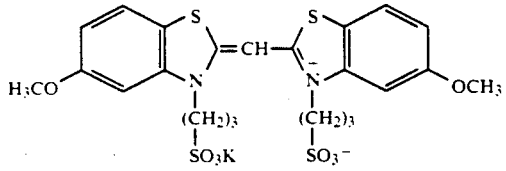

(3)

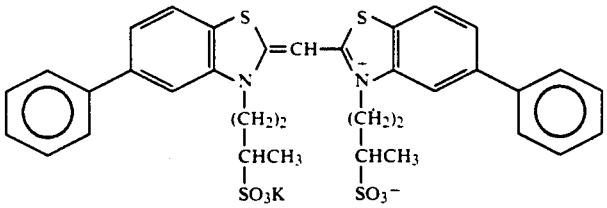

(4)

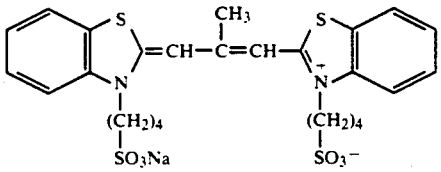

(5)

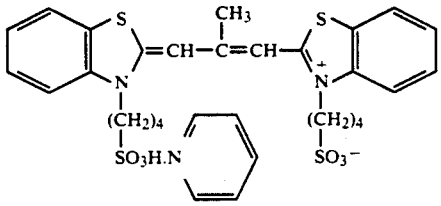

-continued
(6)
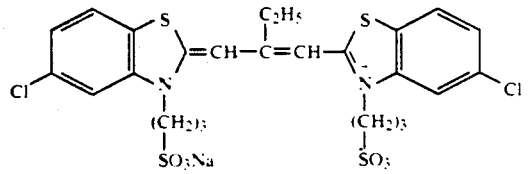
(7)
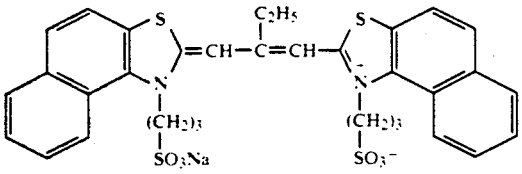
(8)
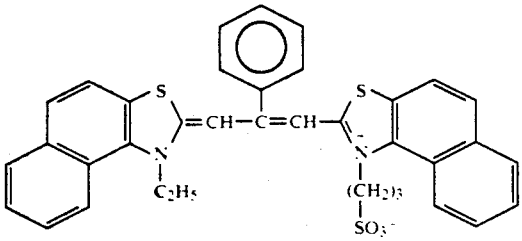
(9)
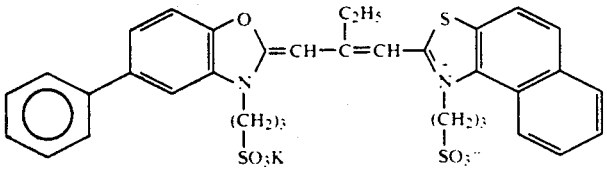
(10)
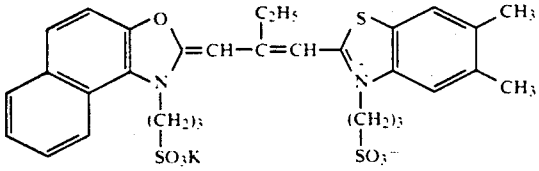
(11)
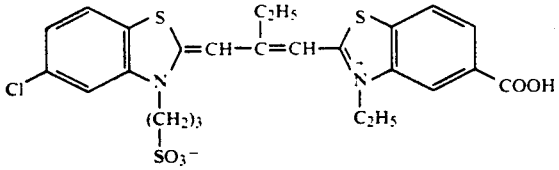
(12)
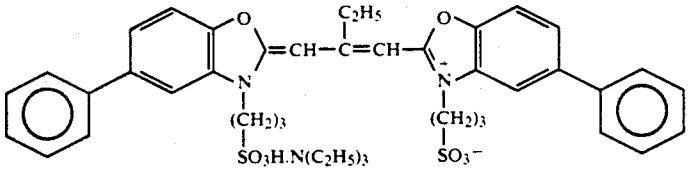
(13)
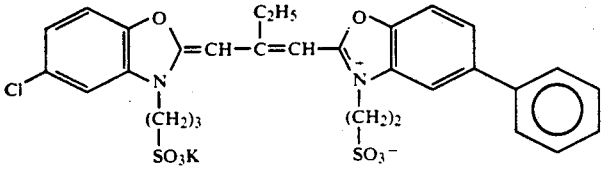

-continued
(14)
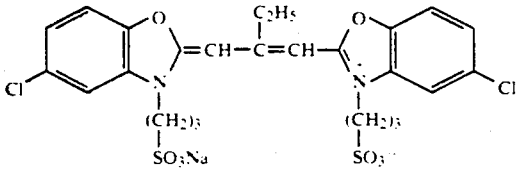
(15)
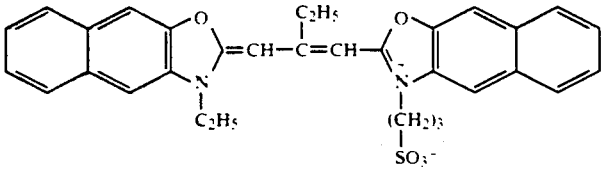
(16)
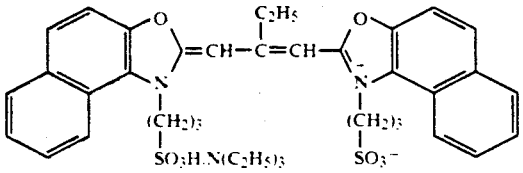
(17)
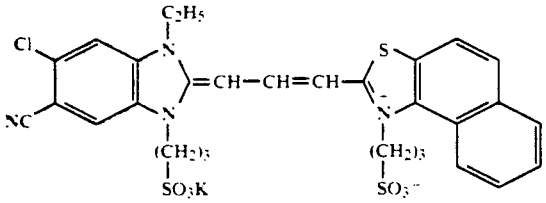
(18)
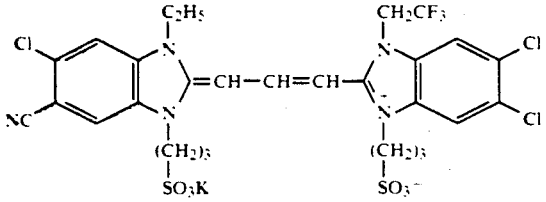
(19)
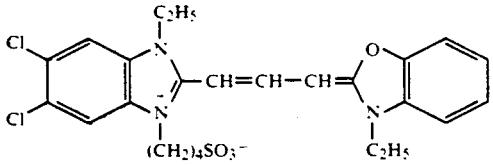
(20)
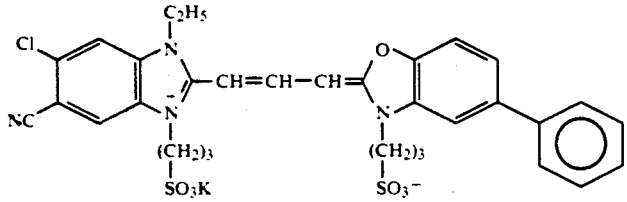
(21)
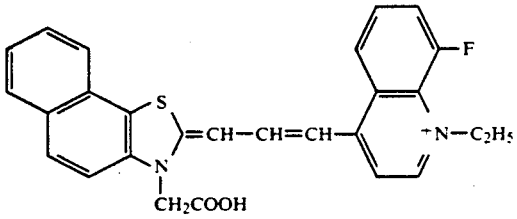

-continued
(22)
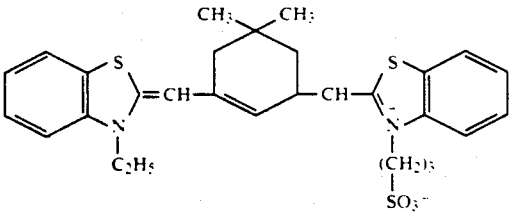
(23)
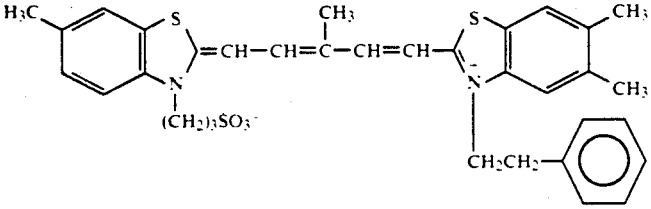
(24)
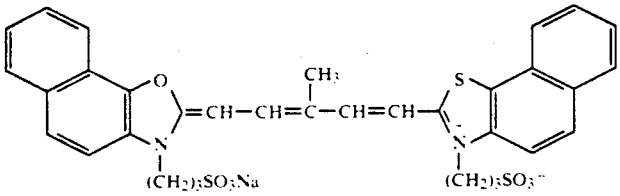
(25)
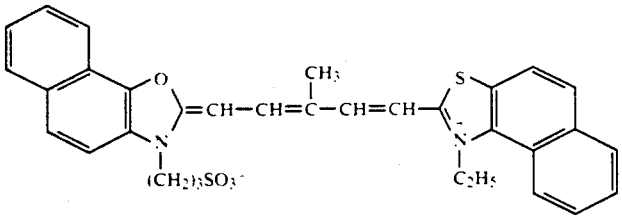
(26)
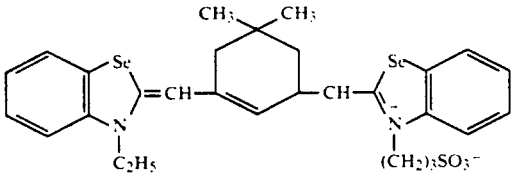
(27)
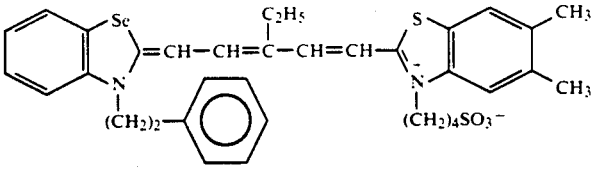
(28)
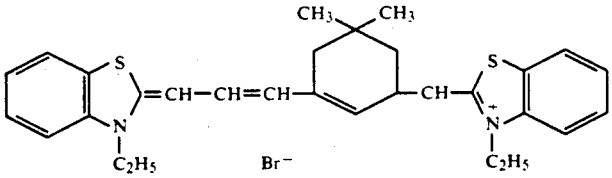
(29)
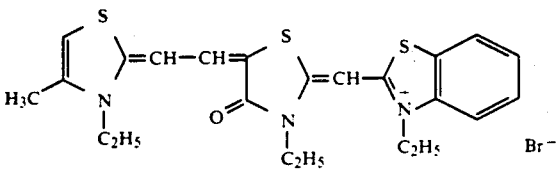

-continued
(30)
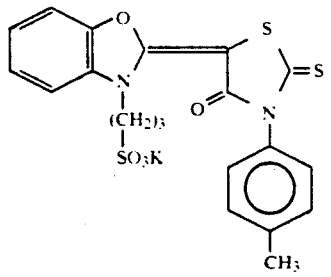
(31)
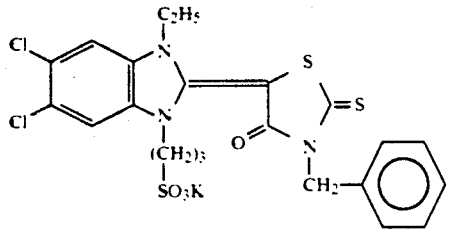
(32)
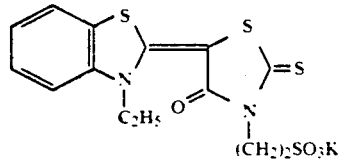
(33)
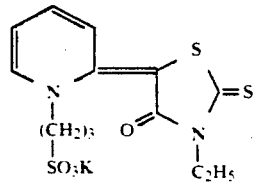
(34)
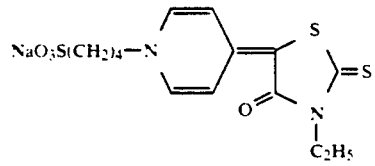
(35)
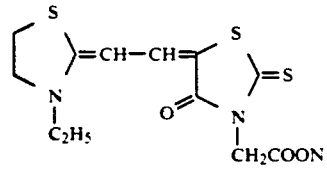
(36)
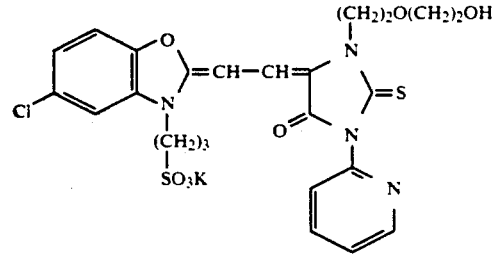

-continued (37)

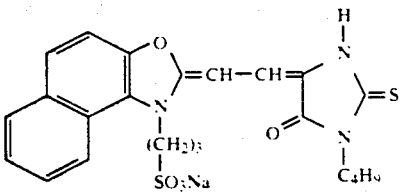

(38)

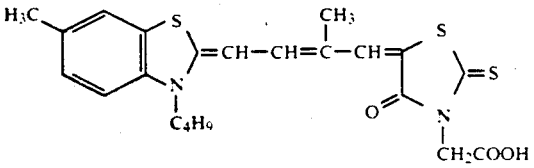

(39)

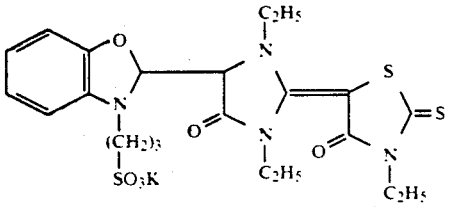

(40)

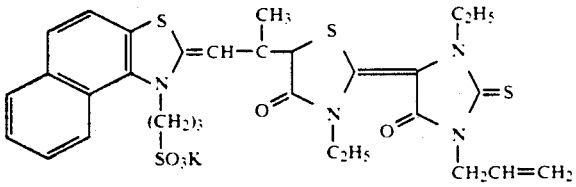

(41)

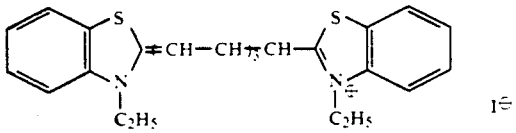

(42)

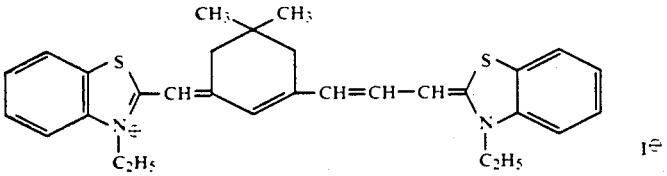

(43)

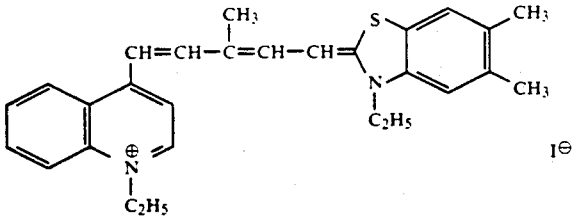

Among the above compounds, cyanine dyes are preferred.

The tabular grains for use in the present invention are illustrated in detail below.

Useful tabular silver halide emulsions are described in Cugnac and Chateau, *Evolution of The Morpholgy of Silver Bromide Crystals During Physical Ripening.* Science et Industrie Photography, Vol., 33, No. 2 (1962), pages 121 to 125; Duffin, *Photographic Emulsion chemistry* (Focal Press, New York 1966), pages 66 to 72; A.P.H. Trivclli and W.F. Smith, *Photographic Journal,* Vol. 80, page 285 (1940), etc., and are easily prepared according to the methods described in JP-A-58-127921, JP-A-58-113927, JP A-58-113928 and U.S. Pat. No. 4,439,520.

Furthermore, the tabular grains for use in the present invention can be prepared in such a manner that seed crystals containing at least 40% by weight of tabular grains are formed in an environment having a relatively low pBr value of not higher than 1.3. The seed crystals are grown by simultaneously adding a silver salt solution and a halogen salt solution while maintaining the pBr value at about the above value.

It is preferred that a silver salt solution and a halogen salt solution are added during the course of the growth of grains in such a manner as to prevent new crystal nuclei from being formed.

The size of the tabular silver halide grains can be adjusted by regulating temperature, appropriately selecting the types and amounts of the solvents used in the preparation thereof, and by controlling the addition rate of the silver salt and halide during the growth of the grains.

Among the tabular silver halide grains, monodisperse hexagonal tabular grains are particularly preferred.

For details of the structure and preparation of monodisperse hexagonal tabular grains for use in the present invention reference is made to JP-A-63-151618. Briefly, the emulsion described therein is a silver halide emulsion comprising a dispersion medium and hexagonal tabular silver halide grains having a ratio of the length of the longest side to the length of the shortest side of not higher than 2 and having two parallel planes as outer surfaces, said hexagonal tabular silver halide grains accounting for at least 70% of the total projected area of the silver halide grains. Furthermore, the tabular hexagonal silver halide grains constitute a monodisperse system having a coefficient of variation of the grain size distribution (a value obtained by dividing the variation in grain size as represented by the diameter of a circle corresponding to the projected area (that is, the standard deviation) by mean grain size) of not higher than 20%. The crystal structure may be uniform, and the outer portion and the inner portion of the halogen composition within the grain preferably differ from each other. The crystal structure may constitute a laminar structure. Preferably, the grains contain reduction-sensitized silver nuclei.

The tabular emulsion of the present invention has a grain size distribution such that grains having an average aspect ratio of not lower than 3.0 constitute at least 50% of the total projected area of the silver halide grains. Preferably, the aspect ratio of all of the grains having a thickness of not more than 0.3 μm is not lower than 3, particularly preferably not lower than 5, but not higher than 10.

In the tabular emulsions of the present invention, the diameter of the average projected area is 1.6 μm, and the distance between parallel planes (the thickness of the grain) is preferably 0.05 to 0.3 μm, and particularly preferably 0.1 to 0.25 μm.

Halogen conversion type grains as described in U.K. Patent 635,841 and U.S. Pat. No. 3,622,318 in particular, are effectively used in the present invention.

Silver halide emulsions having a higher photographic sensitivity can be obtained by the conversion of the surface of the tabular silver halide grains of the present invention.

Halogen conversion is generally carried out by adding an aqueous halogen solution having a lower solubility product with silver than that of the halogen composition of the grain surface prior to halogen conversion. For example, an aqueous solution of potassium bromide and/or potassium iodide may be added to silver chloride or silver chlorobromide tabular grains, or an aqueous solution of potassium iodide may be added to silver bromide or silver iodobromide tabular grains to effect conversion. The concentration of the aqueous solution to be added preferably is not higher than 30 wt%, and more preferably not higher than 10 wt%. Preferably, the halogen solution for use in conversion is added at a rate of not higher than about 1 mol%/min per mol of silver halide prior to halogen conversion. Furthermore, sensitizing dyes may be present during halogen conversion. Fine grains of silver halide such as silver bromide, silver iodobromide or silver iodide may be added in place of the aqueous halogen solution for use in conversion. The fine grains have a size of not larger than 0.2 μm, preferably not larger than 0.1 μm, and more preferably not larger than 0.05 mm. The amount of halogen to be converted is preferably 0.1 to 1 mol%, particularly preferably 0.1 to 0.6 mol% based on the amount of silver halide prior to conversion.

The halogen conversion method for use in the present invention is not limited to any of the above-described methods, and a combination of these methods may be used in accordance with the intended purpose. With regard to the silver halide composition of the grain surface prior to halogen conversion, the iodide content is preferably not higher than 3 mol%, and particularly preferably not higher than 1.0 mol%.

It is particularly effective to have a solvent for silver halide present in carrying out halogen conversion by the above-described methods. Preferred examples of the solvents include thioether compounds, thiocyanates, ammonia and tetra-substituted thioureas. Among them, the thioether compounds and the thiocyanates are particularly effective. The thiocyanates are used in an amount of preferably 0.5 to 5 g per mole of silver halide, and the thioether compounds are used in an amount of preferably 0.2 to 3 g per mol of silver halide.

Compounds which release restrainers during development as described in JP-A-61-230135 and JP A-63-25653 may be used in the present invention.

Cadmium salt, zinc salt, lead salt, thallium salt, iridium salt or a complex salt thereof, rhodium salt or a complex salt thereof, or iron salt or a complex salt thereof may be present during the formation of the silver halide grains or the physical ripening thereof in the preparation of the silver halide.

Furthermore, silver halide solvents including thiocyanates, ammonia, thioether compounds, thiazolidinethione or tetra-substituted thioureas may be present during the formation of the grains. Among them, preferred solvents for use in the present invention are thiocyanates, ammonia and thioether compounds. The tabular grains described in JP-A-63 305343 are particularly preferably used in the present invention.

The photographic emulsion of the present invention may contain various compounds in addition to the nitrogen-containing heterocyclic compound as used in the chemical sensitization stage to prevent fogging during the manufacturing process, storage or processing of the photographic material, or to stabilize the photographic performance. Examples of such compounds known as anti-fogging agents or stabilizers include azoles (e.g., benzthiazolium salts, nitroimidazoles, nitrobenzimidazoles, chlorobenzimidazoles, bromobenzimidazoles, nitroindazoles, benztriazoles, aminotriazoles); mercapto compounds (e.g., mercaptothiazoles, mercaptobenzthiazoles, mercaptobenzimidazoles, mercaptothiadiazoles, mercaptotetrazoles, mercaptopyrimidines, mercaptotriazines); thio-keto compounds such as oxazolinethione; azaindenes (e.g., triazaindenes, tetrazaindenes (particularly 4-hydroxy-substituted (1,3,3a,7) tetrazaindenes), pentazaindenes); and benzenesulfonic acid, benzenesulfinic acid and benzenesulfonamide.

Nitron and derivatives thereof described in JP-A-60-76743 and JP-A-60-87322, mercapto compounds described in JP-A-60-80839, and heterocyclic compounds and complex salts of heterocyclic compounds with silver such as 1-phenyl-5-mercaptotetrazole silver described in JP-A-57-164735 are preferably used in the present invention.

The photographic emulsion and other hydrophilic colloid layers of the photographic material of the present invention may contain various surfactants as coating aids or for imparting antistatic properties, improving slit properties, preparing an emulsifying dispersion and enhancing photographic characteristics (e.g., development acceleration, film hardening, sensitization) or for preventing sticking.

Examples of surfactants for use in the present invention include nonionic surfactants such as saponin (steroid), alkylene oxide derivatives (e.g., polyethylene glycol, polyethylene glycol/polypropylene glycol condensate, polyethylene glycol alkyl ethers, polyethylene glycol alkylaryl ethers, polyethylene oxide adducts of silicone) and alkyl esters of saccharide; anionic surfactants such as alkylsulfonates, alkylbenzenesulfonates, alkylnaphthalenesulfonates, alkylsulfuric esters, N-acyl-N-alkyltaurines, sulfosuccinic esters and sulfoalkylpolyoxyethylene alkylphenyl ethers; ampholytic surfactants such as alkylbetaines and alkylsulfobetaines; and cationic surfactants such as aliphatic or aromatic quaternary ammonium salts, pyridinium salts and imidazolium salts.

Among them, preferred surfactants include saponin, anions such as the sodium salt of dodecylbenzenesulfonic acid, the sodium salt of di-2-ethylhexyl α-sulfosuccinate, the sodium salt of p-octylphenoxyethoxyethanesulfonic acid, the sodium salt of dodecylsulfuric acid, the sodium salt of triisopropylnaphthalenesulfonic acid and the sodium salt of N-methyl-oleoyltaurine, cations such as dodecyltrimethylammonium chloride, N-oleoyl-N',N',N'-trimethylammoniodiaminopropane bromide and dodecylpyridium chloride, betaines such as N-dodecyl-N,N-dimethylcarboxybetaine and N-oleyl-N,N-dimethylsulfobutylbetaine, and nonions such as poly(average polymerization degree n=10)oxyethylene cetyl ether, poly(n=25)oxyethylene p-nonylphenol ether and bis(1-poly(n=15)oxyethylene-oxy-2,4-di-t-pentylphenyl)ethane.

Examples of antistatic agents for use in the present invention include fluorine-containing surfactants such as the potassium salt of perfluorooctanesulfonic acid, the sodium salt of N-propyl-N-perfluorooctanesulfonylglycine, the sodium salt of N-propyl-N-perfluorooctanesulfonylaminoethyloxy poly(n=3)oxyethylene butanesulfonic acid, N-perfluorooctanesulfonyl-N',N', N'-trimethylammoniodiaminopropane chloride and N-perfluorodecanoylaminopropyl-N',N'-dimethyl-N'-carboxybetaine; the nonionic surfactants described in JP-A-60-80848, JP-A-61-112144, JP-A-62-172343 and JP-A-62-173459, alkali metal nitrates, electrically conductive tin oxide, zinc oxide, vanadium pentoxide and composite oxides thereof doped with antimony, etc.

Examples of matting agents for use in the present invention include fine particles of organic compounds such as polymethyl methacrylate homopolymer, copolymer of methyl methacrylate with methacrylic acid and starch, and fine particles of inorganic compounds such as silica, titanium dioxide and strontium barium sulfate as described in U.S. Pat. Nos. 2,992,101, 2,701,245, 4,142,894 and 4,396,706. The particle size thereof is preferably 1.0 to 10 μm, and particularly preferably 2 to 5 μm.

The surface layers of the photographic material of the present invention may contain, as a slip agent, a silicone compound described in U.S. Pat. Nos. 3,489,576 and 4,047,958, the colloidal silica described in JP-B-56-23139, paraffin wax, higher fatty acid esters and starch derivatives.

The hydrophilic colloid layers of the photographic material of the present invention may contain, as a plasticizer, polyols such as trimethylol propane, pentanediol, butanediol, ethylene glycol and glycerin.

Gelatin and other hydrophilic colloid can be used as a binder or protective colloid for the emulsion layers, interlayers and surface protective layers of the photographic material of the present invention. Examples of useful hydrophilic colloids include proteins such as gelatin derivatives, graft polymers of gelatin with other high-molecular materials, albumin and casein; cellulose derivatives such as hydroxylethyl cellulose, carboxymethyl cellulose and cellulose sulfate; saccharide derivatives such as sodium alginate, dextran and starch derivatives; and various synthetic hydrophilic materials such as polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole and copolymers thereof.

Examples of gelatin for use in the present invention include lime-processed gelatin, acid-processed gelatin, enzyme-processed gelatin, hydrolyzates of gelatin and enzymatic hydrolyzates of gelatin.

It is preferred that the gelatin is used together with dextran having an average molecular weight of 5,000 to 10,000, or with a polyacrylamide. The methods described in JP-A-63-68837 and JP-A-63-149641 are effectively used in the present invention.

The photographic emulsion and non-sensitive hydrophilic colloid layers of the present invention may contain inorganic or organic hardening agents. Examples of useful hardening agents include chromium salts (e.g., chromium alum), aldehydes (e.g., formaldehyde, glutaraldehyde), N-methylol compounds (e.g., dimethylol urea), dioxane derivatives (e.g., 2,3-dihydroxydioxane), active vinyl compounds (e.g., 1,3,5-triacryloyl-hexahydro-s-triazine, bis(vinylsulfonyl)methyl ether, N,N'-methyl-enebis(β-vinylsulfonyl)propioneamide), active halogen compound (e.g., 2,4-dichloro-6-hydroxy-s-triazine), mucohalogenic acids (e.g., mucochromic acid), isoxazoles, dialdehydostarch and 2-chloro-6-hydroxytriazinyl triazinyl gelatin. These compounds may be used either alone or in combination. Among them, the active vinyl compounds described in JP-A-53-41221, JP-A-53-57257, JP-A-59-162546 and JP-A-60-80846, and the compounds described in U.S. Pat. No. 3,325,287 are preferred.

N-Carbamoylpyridiniums (e.g., 1-morpholinocarbonyl-3-pyridinio)methanesulfonate) and haloamidinium salts (e.g., 1-(1-chloro-1-pyridinomethylene)pyrrolidinium 2-naphthalenesulfonate) are also useful.

Highmolecular weight hardening agents are effectively used as the hardening agent of the present invention.

Examples of the high-molecular hardening agent for use in the present invention include dialdehydostarch and polyacrolein; polymers having an aldehyde group such as the acrolein copolymers described in U.S. Pat. No. 3,396,029; polymers having an epoxy group described in U.S. Pat. No. 3,623,878; polymers having a dichlorotriazine group as described in U.S. Pat. No. 3,362,827 and *Rich Disclosure*, 17333 (1978); polymers having an active ester group as described in JP-A-56-66841; and polymers having active vinyl group or a precursor group thereof as described in JP-A-56-142524, U.S. Pat. No. 4,161,407, JP-A-54-65033 and *Research Disclosure* 16725 (1978). The polymers having active vinyl group or a precursor group thereof are preferred. Among them, particularly preferred polymers include those having an active vinyl group attached to a main polymer chain by means of a long spacer or a precursor group as described in JP-A-56-142524.

A polyethylene terephthalate film or cellulose triacetate film is preferred as the support for use in the present invention.

Preferably, the surface of the support is subjected to corona discharge treatment, glow discharge treatment or ultraviolet irradiation treatment to improve the adhesion of the support to the hydrophilic colloid layers. Alternatively, a subbing layer comprising a styrene/-butadiene latex or vinylidene chloride latex may be provided on the support. A gelatin layer may be provided on the subbing layer.

A subbing layer may be provided by coating a solution of an organic solvent containing a polyethylene swelling agent and gelatin. When the surface of the subbing layer is treated as described above regarding the support the adhesion of the thus treated subbing layer to the hydrophilic colloid layers is further improved.

The photographic emulsion layer or other hydrophilic colloid layers of the silver halide photographic material of the present invention may be colored with dyes to absorb light in a specific wavelength region, namely, to prevent halation or irradiation, or a filter layer may be provided to control the spectral composition of light incident onto the photographic emulsion layer. Double-sided films such as X-ray films for direct medical use may be provided with a dye-containing layer beneath the sensitive emulsion layers to reduce cross-over effects. Examples of dyes for use in preparing the colored layers of the present invention include oxonol dyes having a pyrazolone nucleus or a barbituric acid nucleus, azo dyes, azomethine dyes, anthraquinone dyes, arylidene dyes, styryl dyes, triarylmethane dyes, merocyanine dyes and cyanine dyes.

Typical examples of the dyes include, but are not limited to, the following compounds.

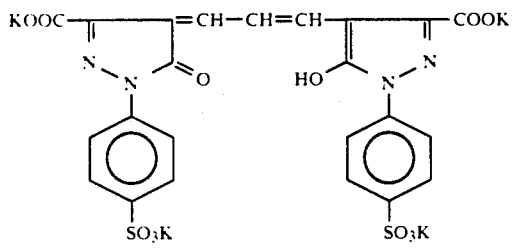

(a)

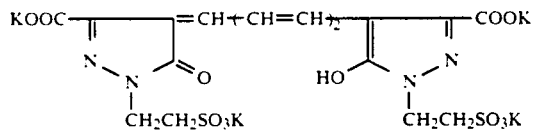

(b)

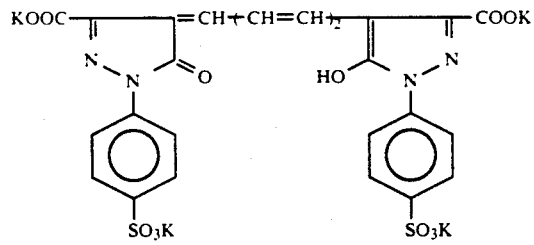

(c)

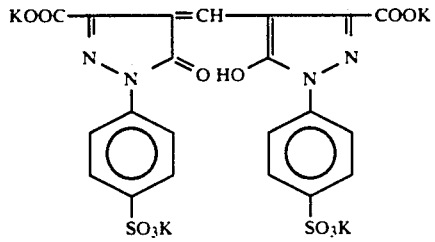

(d)

-continued
(e)
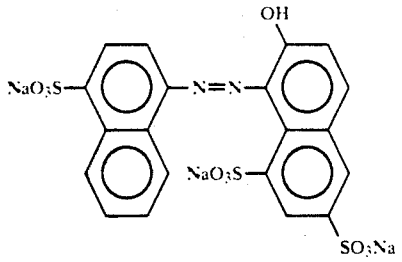
(f)
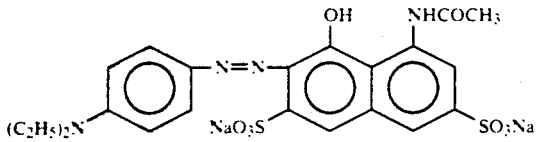
(g)
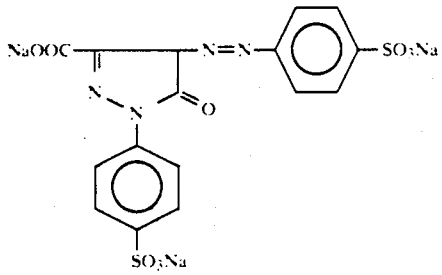
(h)
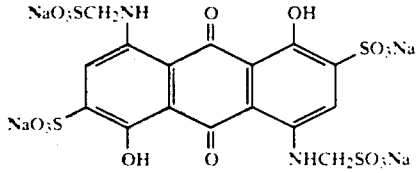
(i)
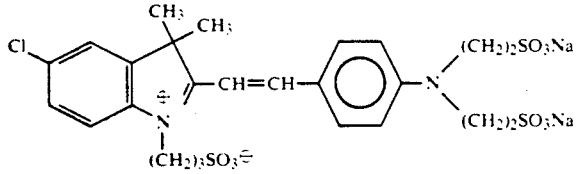
(j)
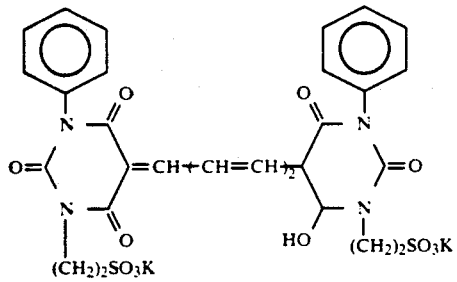
(k)
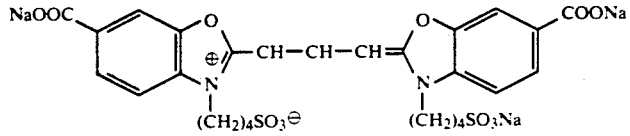

-continued

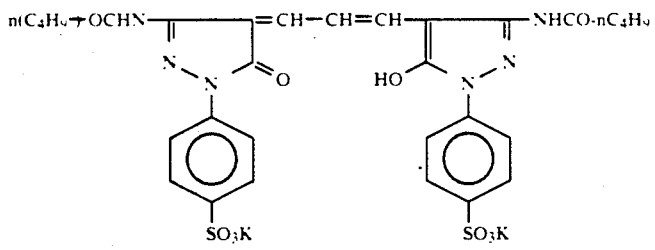

(l)

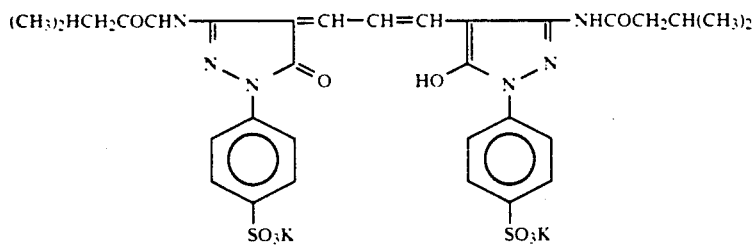

(m)

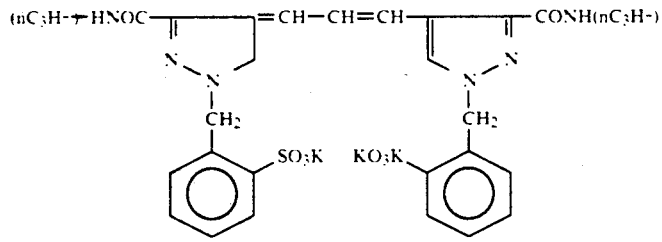

(n)

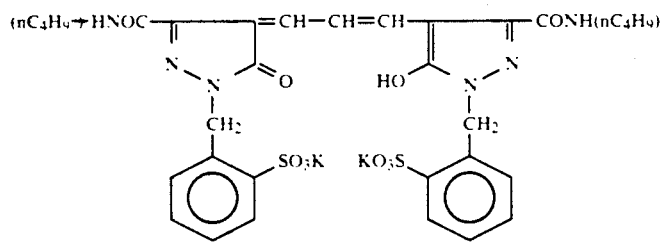

(O)

In the present invention, the above described anionic dyes are effectively fixed to a specific layer of the photographic material by using a mordanting polymer having a cationic site. In the above case, it is preferred to use dyes which are irreversibly decolorized in the development-fixing-rinsing processing. The layer to which the dyes are fixed using the polymer having a cationic site may be an emulsion layer or a surface protective layer. The layer containing the mordanting dye may be arranged on the side of the support opposite to the emulsion layer. Preferably, the layer containing the mordanted dye is provided between the emulsion layer and the support. It is particularly preferred that the dyes are fixed to the subbing layer to reduce cross-over in double-sided X-ray films for medical use in accordance with the present invention.

The added amount of the dyes is preferably from 5 to 500 mg/m$^2$.

The solid dispersion methods described in JP-A-55-155350 and WO 88/04794 are effectively used to fix the dyes.

Polyethylene oxide nonionic surfactants as coating aid for the subbing layer are preferably used in combination with the polymer having a cationic site. Anion conversion polymers are preferred as the polymer having a cationic site.

Useful anion conversion polymers include conventional quaternary ammonium salt (or phosphonium salt) polymers. The quaternary ammonium salt (or phosphonium salt) polymers are widely known as mordant polymers or antistatic polymers.

Examples of these polymers include the water-dispersed latexes described in JP-A-59-166940, U.S. Pat. No. 3,958,995, JP-A-55-142339, JP-A-54-126027, JP-A-54-155835, JP-A-53-30328 and JP-A-54-92274; the polyvinyl pyridinium salts described in U.S. Pat. Nos. 2,548,564, 3,148,061 and 3,756,814; the water-soluble quaternary ammonium salt polymers described in U.S. Pat. No. 3,709,690; and the water-insoluble quaternary ammonium salt polymers described in U.S. Pat. No. 3,898,088.

In order to prevent the mordanting polymers from migrating from the desired layer to other layers or into the processing solutions to thereby adversely influence photographic properties, it is particularly preferred to use aqueous polymer latexes obtained by copolymerizing monomers having at least two (preferably two to four) ethylenically unsaturated groups, and crosslinking the resulting copolymer.

Examples of such mordanting polymers for use in the present invention include the following compounds.

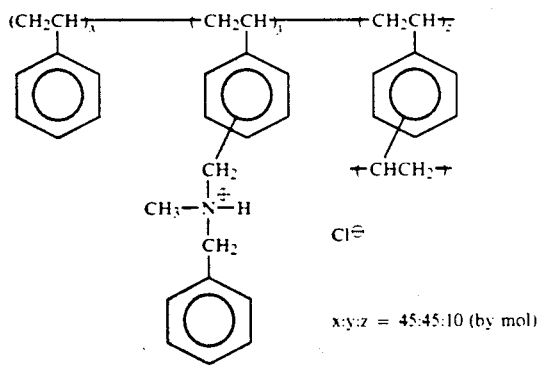

(A)

x:y:z = 45:45:10 (by mol)

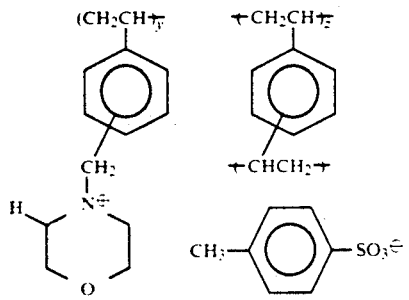

(B)

y:z = 95:5 (by mol)

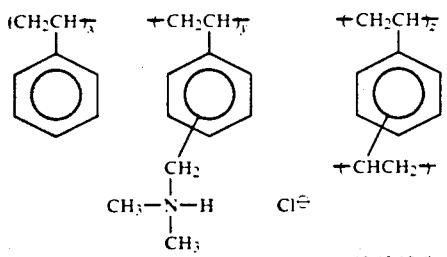

(C)

x:y:z = 45:45:10 (by mol)

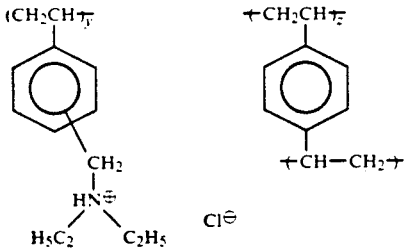

(D)

y:z = 80:20 (by mol)

There is no particular limitation with regard to methods for coating the emulsion layers, surface protective layers, etc. on the support for preparing the photographic material of the present invention. However, the multi-layer co-coating methods described in U.S. Pat. Nos. 2,761,418, 3,508,947 and 2,761,791 are preferred.

The developing solution for processing the image-wise exposed photographic material of the present invention may contain conventional developing agents. Examples of useful developing agents include dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in combination. The developing solution generally contains conventional preservatives, alkaline agents, pH buffering agents and anti-fogging agents. If desired, the developing solution may contain a dissolution aid, color toning agent, development accelerator (e.g., quaternary salt, hydrazine, benzyl alcohol), surfactant, anti-foaming agent, water softener, hardening agent (e.g., glutaraldehyde) and tackifier.

Fixing solutions having a conventional composition can be used. Examples of fixing agents for use in the present invention include thiosulfates and thiocyanates. In addition thereto, known organosulfur compounds which act as fixing agents can be used. The fixing solutions may contain water-soluble aluminum salts as hardening agents.

It is preferred that a roller conveyor type automatic processor described in U.S. Pat. Nos. 3,025,779, 3,515,556, 3,573,914 and 3,647,459 and U.S. Pat. No. 1,269,268 is used for the processing of the photographic material of the present invention.

Development temperature is preferably 18° to 50° C., and particularly preferably 30° to 45° C. Development time is preferably 8 to 40 seconds, and particularly preferably 8 to 25 seconds.

With regard to the total processing time, the time from commencement of development until the completion of fixing, rinsing and drying is preferably 30 to 200 seconds, and particularly preferably 40 to 100 seconds.

Various additives, developing methods, exposure methods, etc. can be used in the present invention by reference to *Research disclosure*, Vol. 176, item 17643 (December 1978) and ibid., Vol. 184, item 18431 (August 1979) without particular limitation.

The present invention is now illustrated in greater detail by reference to the following examples which, however, are not to be construed as limiting the invention in any way.

EXAMPLE 1

Preparation of Comparative Emulsion A 5 g of potassium bromide, 25.6 g of gelatin and 2.5 cc of a 5 wt% aqueous solution of thioether $HO(CH_2)_2S(CH_2)_2S(CH_2)_2OH$ were added to 1 liter of water. To the resulting solution maintained at 66° C. with stirring, there were added an aqueous solution containing 8.33 g of silver nitrate, an aqueous solution containing 5.94 g of potassium bromide and 0.726 g of potassium iodide, over a period of 45 seconds by the double jet process. Subsequently, 2.9 g of potassium bromide were added thereto, and an aqueous solution containing 8.33 g of silver nitrate was added thereto over a period of 24 minutes. Thereafter, 20 cc of a 25 wt% aqueous ammonia solution and 10 cc of a 50 wt% aqueous NH4N03 solution were added thereto, and physical ripening was carried out for 20 minutes. The mixture was neutralized by adding 240 cc of a 1 N sulfuric acid solution. Subsequently, an aqueous solution of 153.34 g of silver nitrate and an aqueous solution of potassium bromide were added thereto with stirring over a period of 40 minutes by controlled double jet process while keeping the potential at a constant pAg of 8.2. The addition rate was accelerated such that the flow rate at the time of the completion of the addition was 9 times that at the time of the commencement of the addition. After the completion of the addition, 15 cc of a 2 N potassium thiocyanate solution was added thereto, and 45 cc of a 1 wt% aqueous solution of potassium iodide was added thereto over a period cf 30 seconds.

The temperature of the mixture was lowered to 35° C. After soluble salts were removed by precipitation, the temperature was raised to 40° C., and 76 g of gelatin, 76 mg of Proxel (manufactured by I.C.I. (England)) and 760 mg of phenoxyethanol were added thereto. The pH of the mixture was adjusted to 6.50 and the pAg was adjusted to 8.20 using caustic soda and potassium bromide.

After the temperature was raised to 56° C., 520 mg of the following sensitizing dye (14) was added thereto. After 10 minutes, 3.4 mg of sodium thiosulfate pentahydrate, 140 mg of potassium thiocyanate and 3.1 mg of chloroauric acid were added to the emulsion. After 70 minutes, the emulsion was quenched to solidify the same, thus obtaining the emulsion A. The resulting emulsion was composed of grains having a grain size distribution such that grains having an aspect ratio of at least 3 constituted 99.5% of the total projected area of the total grains. With regard to all grains having an aspect ratio of at least 2, the diameter of the average projected area was 1.35 μm and the standard deviation thereof was 22.3%, the average thickness was 0.200 μm, and the average aspect ratio was 6.8.

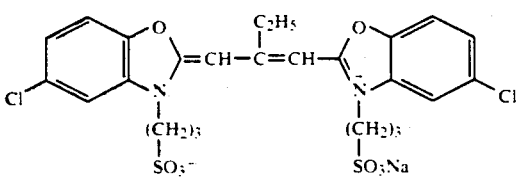

Preparation of Comparative Emulsion B

Tabular grains were formed in the same manner as emulsion A. After the soluble salts were removed by precipitation, the antiseptic (Proxel and phenoxyethanol) was added, and the pH and pAg were adjusted and the temperature was raised to 56° C. in the same manner as in preparation of the emulsion A. 186 mg of 4-hydroxy-6-methyl-1,3,3a,7-tetrazaindene was added to the emulsion 10 minutes before the addition of the sensitizing dye (14). Subsequently, chemical sensitization was carried out in the same manner in the emulsion A.

Preparation of Reduction Sensitized Emulsion C for comparison 5 g of potassium bromide, 25.6 g of gelatin and 2.5 cc of a 5 wt% aqueous solution of thioether $HO(CH_2)_2S(CH_2)_2S(CH_2)_2OH$ were added to 1 liter of water. To the resulting solution maintained at 66° C. with stirring, there were added an aqueous solution of 8.33 g of silver nitrate, an aqueous solution containing 5.94 g of potassium bromide and 0.726 g of potassium iodide, over a period of 45 seconds by the double jet process. Subsequently, 2.9 g of potassium bromide were added thereto, and an aqueous solution containing 8.33 g of silver nitrate was added thereto over a period of 24 minutes. Furthermore, 0.1 mg of thiourea dioxide having the following formula was added thereto.

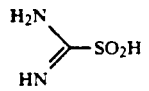

Thereafter, 20 cc of a 25 wt% aqueous ammonia solution and 10 cc of a 50 wt% aqueous $NH_4NO_3$ solution were added thereto, and physical ripening was carried out for 20 minutes. The mixture was neutralized by adding 240 cc of a 1N sulfuric acid solution. Subsequently, an aqueous solution of 153.34 g of silver nitrate and an aqueous solution of potassium bromide were added thereto over a period of 40 minutes by the controlled double jet process while keeping the potential at a constant pAg of 8.2. The addition rate was accelerated such that the flow rate at the time of the completion of the addition was 9 times that at the time of the commencement of the addition. After the completion of the addition, 15 cc of a 2N potassium thiocyanate solution were added, and furthermore 45 cc of a 1 wt% aqueous solution of potassium iodide were added thereto over a period of 30 seconds. The temperature of the mixture was then lowered to 35° C. After soluble salts were removed by precipitation, the temperature was raised to 40° C. 76 g of gelatin, 76 mg of Proxel and 760 mg of phenoxyethanol were added thereto. The pH of the mixture was adjusted to 6.50 and the pAg was adjusted to 8.20 using caustic soda and potassium bromide.

After the temperature was raised to 56° C., 520 mg of the sensitizing dye (14) were added thereto. After 10 minutes, 3.4 mg of sodium thiosulfate pentahydrate, 140 mg of potassium thiocyanate and 3.1 mg of chloroauric acid were added to the emulsion. After 70 minutes, the emulsion was quenched to solidify the same, thus obtaining the emulsion C. The resulting emulsion was composed of grains having a grain size distribution such that grains having an aspect ratio of at least 3 constituted 99.5% of the total projected area of all of the grains. With regard to all of the grains having an aspect ratio of at least 2, the diameter of the average projected area was 1.35 μm and the standard deviation thereof was 22.3%, the average thickness was 0.200 μm and the average aspect ratio was 6.8. The above grain properties of the emulsion C. are almost the same as those of the emulsion A.

Preparation of Emulsion D of the Invention

In the same manner as in the emulsion C, grains were formed by using thiourea dioxide.

After soluble salts were removed by precipitation, the pH and pAg were adjusted and the temperature was raised to 56° C.

186 mg of 4-hydroxy-6-methyl-1,3,3a,7-tetrazaindene were added to the emulsion 10 minutes before the addition of the sensitizing dye (14). Thereafter, chemical sensitization was carried out in the same manner as in the emulsion A.

Preparation of Emulsion E of the Invention

In the same manner as in the emulsion C., grains v were formed by using thiourea dioxide. After soluble salts were removed by precipitation, the antiseptic (Proxel and phenoxyethanol) was added, .and the pH and pAg were adjusted in the same manner as in the preparation of the emulsion A.

After the temperature was raised to 56° C., 0.39 mg of thiourea dioxide were added thereto. The resulting mixture was stirred for 20 minutes, and 213 mg of 4-hydroxy-6-methyl-1,3,3a,7-tetrazaindene were then added thereto. After 10 minutes, 520 mg of the sensitizing dye (14) were added thereto. After 10 minutes, 3.4 mg of sodium thiosulfate pentahydrate, 140 mg of potassium thiocyanate and 3.1 mg of chloroauric acid were added thereto. After 70 minutes, the emulsion was quenched to solidify the same, thus obtaining the emulsion E.

Preparation of Emulsion F of the Invention 5 g of potassium bromide, 25.6 g of gelatin and 2.5 cc of a 5 wt% aqueous solution of thioether $HO(CH_2)_2S(CH_2)_2S(CH_2)_2OH$ were added to 1 liter of water. To the resulting solution maintained at 66° C. with stirring were added an aqueous solution of 8.33 g of silver nitrate, an aqueous solution containing 5.94 g of potassium bromide and 0.726 g of potassium iodide, over a period of 45 seconds by the double jet process. Subsequently, 2.9 g of potassium bromide were added thereto. An aqueous solution containing 8.33 g of silver nitrate was added thereto over a period of 24 minutes. Thereafter, 0.2 mg of thiourea dioxide having the following formula was added.

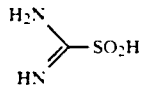

Next, 20 cc of a 25 wt% aqueous ammonia solution and 10 cc of a 50 wt% aqueous $NH_4NO_3$ solution were added thereto, and physical ripening was carried out for 20 minutes. The mixture was neutralized by adding 240 cc of a 1N sulfuric acid solution. Subsequently, an aqueous solution of 153.34 g of silver nitrate and an aqueous solution of potassium bromide were added thereto over a period of 40 minutes by the controlled double jet process, while maintaining potential at a pAg of 8.2. The addition rate was accelerated such that the flow rate at the time of the completion of the addition was 9 times that at the time of the commencement of the addition. After 20 minutes from the commencement of the controlled double jet addition, 10 mg of thiosulfonic acid ($C_2H_5SO_2SNa$) were added. After the completion of the addition, 15 cc of a 2N potassium thiocyanate solution was added, and furthermore 45 cc of a 1 wt% aqueous solution of potassium iodide was added over a period of 30 seconds. After the temperature was lowered to 35° C., soluble salts were removed by precipitation. After the temperature was raised to 40° C., 76 g of gelatin, 76 mg of Proxel and 760 mg of phenoxyethanol were added. The pH of the mixture was adjusted to 6.50, and pAg was adjusted to 8.20 using caustic soda and potassium bromide.

After the temperature was raised to 56° C., 186 mg of 4-hydroxy-6-methyl-1,3,3a,7-tetrazaindene was added thereto. After 10 minutes, 520 mg of the sensitizing dye (14) were added thereto. After 10 minutes, 3.4 mg of sodium thiosulfate pentahydrate, 140 mg of potassium thiocyanate and 3.1 mg of chloroauric acid were added. After 70 minutes, the emulsion was quenched to solidify the same, thus obtaining the emulsion F.

The grain size, aspect ratio, etc. of the resulting emulsion were measured. There was substantially no difference (within the margin of the measurement error) in the measurement values of the resulting emulsion and the emulsion A.

Preparation of Emulsion Coating Solution

The following reagents were added to each of the emulsions A to F to prepare a coating solution, each amount being per mol of silver halide.

| | |
|---|---|
| Polymer latex (poly(ethyl acrylate/methacrylic acid) = 97/3 by weight) | 25.0 g |
| Hardening agent (1,2-bis(sulfonylacetamido)ethane) | 3.0 g |
| 2,6-Bis(hydroxyamino)-4-diethylamino-1,3,5-triazine | 80 mg |
| Poly(sodium acrylate) (average molecular weight: 41,000) | 4.0 g |
| Poly(potassium styrenesulfonate) (average molecular weight: 600,000) | 1.0 g |
| Polyacrylamide (average molecular weight: 45,000) | 24 g |

Preparation of Support

A subbing layer having the following composition was provided on both sides of a blued polyethylene terephthalate base of 175 μm in thickness to prepare a support.

| | |
|---|---|
| Gelatin | 84 mg/m² |
| 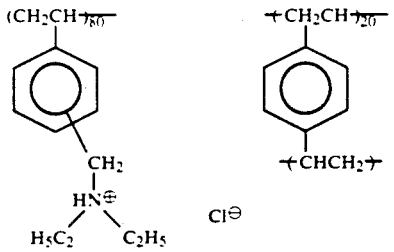 | 60 mg/m² |
| 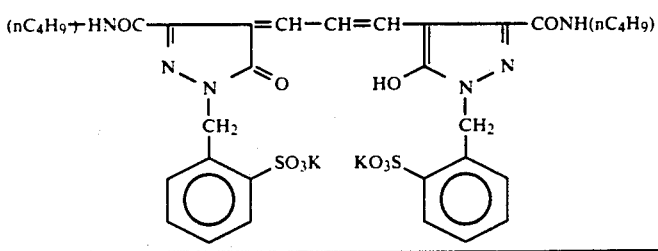 | 17 mg/m² |

Preparation of Photographic Material

The surface of a transparent polyethylene terephthalate film support of 175 μm in thickness was coated with the above-described coating solution simultaneously with a coating solution for the surface protective layer having a composition as described below.

The amount of coated silver was 2.0 g/m$^2$ per each side of the support. Both sides were coated.

The coating solution for the surface protective layer had the following composition. In this way, photographic materials 1 to 6 were prepared.

| Composition of the Surface Protective Layer | Coating weight (g/m$^2$) |
|---|---|
| Gelatin | 1.15 |
| Polyacrylamide (average molecular weight: 45,000) | 0.25 |
| Poly(sodium acrylate) (average molecular weight: 400,000) | 0.02 |
| Sodium salt of p-t-octylphenoxy-diglycerylbutyl sulfonate | 0.02 |
| Poly(polymerization degree = 10)oxyethylene cetyl ether | 0.035 |
| Poly(polymerization degree = 10)oxyethylene-Poly(polymerization degree = 3)oxyglyceryl p-octylphenoxy ether | 0.01 |
| 4-Hydroxy-6-methyl-1,3,3a,7-tetrazaindene | 0.0155 |
| Hydroquinone | 0.117 |
| $C_8F_{17}SO_3K$ | 0.003 |
| $C_8F_{17}SO_2N(C_3H_7)(CH_2)_4(CH_2)_4SO_3Na$ | 0.001 |
| $C_8H_{17}SO_2N(C_3H_7)(CH_2CH_2O)_{10}(CH_2CHCH_2O)_4H$ | 0.003 |
| Polymethyl methacrylate (average particle diameter: 3.5 μm) | 0.025 |
| Poly(methyl methacrylate/methacrylate) (molar ratio = 7:3) (average particle diameter: 2.5 μm) | 0.020 |

Evaluation of Photographic Performance

The photographic materials 1 to 6 were exposed through both sides thereof for 1/20 of a second using green light having a peak at 550 nm. The materials were then subjected to SP processing (dry to dry processing time of 45 seconds) at 35° C. by using the developing solution RD7, the fixing solution Fuji F and the automatic processor FPM 9000 (all manufactured by the Fuji Photo Film Co., Ltd.).

Sensitivity was represented by the reciprocal of the exposure amount providing a density of Fog +1.0. The sensitivity of the photographic material 1 was referred to as 100. The reported sensitivity for the remaining samples is relative to the photographic material 1. The results are shown in Table 1.

Fog was represented by the total value including the density of the support. The fog value of the support per se processed with the above-described automatic processor was 0.125.

It is apparent from Table 1 that the photographic materials 4 to 6 of the present invention wherein the reduction sensitized emulsions were subjected to gold and sulfur sensitization in the presence of a nitrogen-containing heterocyclic compound, have high sensitivity and are low in fogging, and hence provide excellent photographic characteristics.

TABLE 1

| Photographic material | Amount of thiourea dioxide added during formation of grains (mg/Ag mol) | Amount of thiosulfonic acid added during formation of grains (mg/Ag mol) | Amount of thiourea dioxide added after formation of grains (mg/Ag mol) | Amount of 4-hydroxy-6-methyl-1,3,3a,7-tetrazaindene added (mg/Ag mol) | Sensitivity | Fog |
|---|---|---|---|---|---|---|
| 1 (Comparison) | omitted | omitted | omitted | omitted | 100 | 0.215 |
| 2 (Comparison) | omitted | omitted | omitted | 186 | 85 | 0.150 |
| 3 (Comparison) | 0.1 | omitted | omitted | omitted | 110 | 0.235 |
| 4 (Invention) | 0.1 | omitted | omitted | 186 | 110 | 0.155 |
| 5 (Invention) | 0.1 | omitted | 0.39 | 213 | 117 | 0.150 |
| 6 (Invention) | 0.2 | 10 | omitted | 186 | 117 | 0.150 |

EXAMPLE 2

Preparation of Comparative Emulsion G 5 g of potassium bromide, 20 g of gelatin and 2.5 cc of a 5 wt% aqueous solution of thioether $HO(CH_2)_2S(CH_2)_2S(CH_2)_2OH$ were added to 1 liter of water. To the resulting solution maintained at 60° C. with stirring, there were added an aqueous solution of 8.33 g of silver nitrate, an aqueous solution containing 5.94 g of potassium bromide, and 0.726 g of potassium iodide over a period of 45 seconds by the double jet process. Subsequently, 2.9 g of potassium bromide was added thereto, and an aqueous solution containing 8.33 g of silver nitrate was added thereto over a period of 24 minutes. Thereafter, 22 cc of a 25 wt% aqueous ammonia solution and 10 cc of a 50 wt% aqueous $NH_4NO_3$ solution were added thereto and physical ripening was carried out for 20 minutes. The mixture was neutralized by adding 260 cc of a 1N sulfuric acid solution. Subsequently, an aqueous solution of 153.34 g of silver nitrate and an aqueous solution of potassium bromide were added thereto over a period of 40 minutes by controlled double jet process while maintaining the potential at a pAg of 8.2. The addition rate was accelerated such that the flow rate at the time of the completion of the addition was 9 times that at the time of the commencement of the addition. After the completion of the addition, 15 cc of a 2N potassium thiocyanate solution was added thereto, and further 55 cc of a 1 wt% aqueous solution of potassium iodide was added thereto over a period of 30 seconds. The temperature was lowered to 35° C. After soluble salts were removed by precipitation, the temperature was raised to 40° C. 76 g of gelatin, 76 mg of Proxel and 760 mg of phenoxyethanol were added thereto. The pH of the mixture was adjusted to 6.60 and the pAg was adjusted to 8.20 using caustic soda and potassium bromide.

After the temperature was raised to, 56° C., 600 mg of the sensitizing dye (14) were added thereto. After 10 minutes, 3.4 mg of sodium thiosulfate pentahydrate, 140 mg of potassium thiocyanate and 3.1 mg of chloroauric acid were added to the emulsion. After 90 minutes, the emulsion was quenched to solidify the same, thus obtaining the emulsion G. The resulting emulsion had a grain size distribution such that grains having an aspect ratio of at least 3 constituted 97% of the total projected area of all of the grains. With regard to all grains having an aspect ratio of at least 2, the diameter of average projected area was 0.86 μm and the standard deviation thereof was 14.7%, the average thickness was 0.172 μm and the average aspect ratio was 5.0.

Preparation of Comparative Emulsion H

Tabular grains were formed in the same manner as comparative emulsion G. After soluble salts were removed by precipitation, the antiseptic (Proxel and phenoxyethanol) was added, the pH and pAg were adjusted, and the temperature was raised to 56° C.

213 mg of 4-hydroxy-6-methyl-1,3,3a,7-tetrazaindene was added to the emulsion 10 minutes before the addition of the sensitizing dye (14). Thereafter, chemical sensitization was carried out in the same manner as in the emulsion G.

Preparation of Reduction-Sensitized Emulsion I for Comparison 5 g of potassium bromide, 25.6 g of gelatin and 2.5 cc of a 5 wt% aqueous solution of thioether $HO(CH_2)_2S(CH_2)_2S(CH_2)_2OH$ were added to 1 liter of water. To the resulting solution maintained at 66° C. with stirring, there were added an aqueous solution of 8.33 g of silver nitrate, an aqueous solution containing 5.94 g of potassium bromide, and 0.726 g of potassium iodide over a period of 45 seconds by the double jet process. Subsequently, 2.9 g of potassium bromide were added thereto, and an aqueous solution containing 8.33 g of silver nitrate was added thereto over a period of 24 minutes. Further, 10 mg of sodium thiosulfonate ($C_2H_5SO_2SNa$) was added thereto.

Thereafter, 22 cc of a 25 wt% aqueous ammonia solution and 10 cc of a 50 wt% aqueous $NH_4NO_3$ solution were added, and physical ripening was carried out for 20 minutes. The mixture was neutralized by adding 260 cc of a 1N sulfuric acid solution. Subsequently, an aqueous solution of 153.34 g of silver nitrate and an aqueous solution of potassium bromide were added thereto over a period of 40 minutes by the controlled double jet process while maintaining the potential at a pAg of 8.2. The addition rate was accelerated such that the flow rate at the time of the completion of the addition was 9 times that at the time of the commencement of the addition. After 10 minutes from the commencement of controlled double jet addition, 0.2 g of ascorbic acid having the following formula was added.

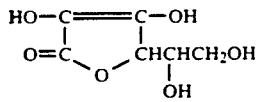

After the completion of the addition, 15 cc of a 2N potassium thiocyanate solution was added thereto, and additionally 55 cc of a 1 wt% aqueous solution of potassium iodide was added thereto over a period of 30 seconds. The temperature was lowered to 35° C., and soluble salts were removed by precipitation. The temperature was raised to 40° C. Subsequently, 76 g of gelatin, 76 mg of Proxel and 760 mg of phenoxyethanol were added thereto. The pH of the mixture was adjusted to 6.60 and the pAg was adjusted to 8.20 using caustic soda and potassium bromide.

After the temperature was raised to 56° C., 600 mg of the sensitizing dye (14) was added. After 10 minutes, 3.4 mg of sodium thiosulfate pentahydrate, 140 mg of potassium thiocyanate and 3.1 mg of chloroauric acid were added to the emulsion. After 70 minutes, the emulsion was quenched to solidify the same, thus obtaining the emulsion I. The emulsion I was measured to have almost the same grain size as the comparative emulsion G.

Preparation of Emulsion J of the Invention

In the same manner as emulsion I, grains were formed using thiosulfonic acid and ascorbic acid.

After soluble salts were removed by precipitation, the pH and pAg were adjusted and the temperature was raised to 56° C.

213 mg of 4-hydroxy-6-methyl-1,3,3a,7-tetrazaindene were added to the emulsion 10 minutes before the addition of the sensitizing dye (14). Thereafter, chemical sensitization was carried out in the same manner as in the emulsion G.

Preparation of Photographic Materials 7 to 10

Each coating solution of the emulsions G to J, a coating solution for surface protective layer and a support were prepared in the same manner as in Example 1. Both sides of the support were coated to prepare each of photographic materials G to J. The amount of coated silver was 1.5 g/m2 per side of the support, and the coating weights of the surface protective layer were the same as those of Example 1.

Evaluation of Photographic Performance

Photographic performance was evaluated in the same manner as in Example 1. The results are shown in Table 2. The effect of the invention is clear from Table 2. The sensitivity of the photographic material 7 was assigned a value of 100. The sensitivity of the other materials is reported relative to the photographic material 7.

TABLE 2

| Photographic material | Reduction sensitization | Nitrogen-containing heterocyclic compound | Sensitivity | Fog |
|---|---|---|---|---|
| 7 (comparison) | omitted | omitted | 100 | 0.170 |
| 8 (comparison) | omitted | added | 90 | 0.140 |
| 9 (comparison) | conducted | omitted | 120 | 0.215 |
| 10 (Invention) | conducted | added | 120 | 0.145 |

While the invention has been described in detail and with reference to specific embodiments thereof, it will be apparent to one skilled in the art that various changes and modifications can be made therein without departing from the spirit and scope thereof.

What is claimed is:

1. A process for preparing a chemically sensitized tabular silver halide emulsion comprising the steps of:

first reacting a water-soluble silver salt and a water-soluble alkali halide in an aqueous reaction system containing gelatin and adding to the reaction system either during grain formation or after grain formation a reduction sensitizing agent to form a reduction sensitized tabular silver halide emulsion containing tabular silver halide grains;

next adding a nitrogen-containing heterocyclic compound which forms a complex with silver following formation of the reduction sensitized tabular silver halide grains;

adding a sulfur sensitizing agent simultaneously with or after addition of the nitrogen-containing heterocyclic compound to effect sulfur sensitization of the tabular silver halide grains; and adding a gold sensitizing agent following addition of the nitrogen-containing heterocyclic compound and during or following addition of the sulfur sensitizing agent to effect gold sensitization of the tabular silver halide grains, said tabular emulsion having a grain size distribution such that grains having an average aspect ratio of not lower than 3.0 constitute at least 50% of the total projected area of all of the total silver halide grains.

2. A process as in claim 1, wherein the reduction sensitizing agent for the reduction sensitization is selected from ascorbic acid, thiourea dioxide and dimethylamine borane.

3. A process as in claim 2, wherein the reduction sensitizing agent is added in an amount of from $1\times10^{-8}$ to $1\times10^{-3}$ mol per mol of silver halide.

4. A process as in claim 1, wherein the nitrogen-containing heterocyclic compound is an azaindene compound.

5. A process as in claim 1, wherein the nitrogen-containing heterocyclic compound is an azaindene compound having a hdyroxyl group as a substituent.

6. A process as in claim 1, wherein the ratio of the addition amount of the gold sensitizing agent to the addition amount of the sulfur sensitizing agent is such that the ratio of the number of gold atoms to the number of sulfur atoms which form silver sulfide upon reaction of the sulfur sensitizing agent with the silver halide grains is from ½ to 1/200.

7. A process as in claim 1, wherein the nitrogen-containing heterocyclic compound is used together with a spectral sensitizing dye selected from cyanine dyes, merocyanine dyes, complex cyanine dyes, complex merocyanine dyes, holopolar cyanine dyes, styryl dyes, hemicyanine dyes, oxonol dyes and hemioxonol dyes.

8. A process as in claim 7, wherein the spectral sensitizing dye is added in an amount of from 300 to 1500 mg per mol of silver halide.

9. A process as in claim 8, wherein the spectral sensitizing dye is a cyanine dye.

10. A process as in claim 1, wherein the aspect ratio of all of the grains having a thickness of not more than 0.3 μm is not lower than 3.

11. A process as in claim 10, wherein the aspect ratio is not lower than 5 and not higher than 10.

12. A process as in claim 1, wherein halogen conversion type grains constitute the tabular silver halide emulsion.

13. A process as in claim 18, wherein the silver iodide content of the tabular silver halide grains prior to halogen conversion is not higher than 3 mol%.

* * * * *